US008896223B2

(12) United States Patent
Wu et al.

(10) Patent No.: US 8,896,223 B2
(45) Date of Patent: Nov. 25, 2014

(54) LIGHT EMITTING DIODE DRIVING DEVICE

(75) Inventors: Chih-Hsien Wu, New Taipei (TW); Wei Chang, New Taipei (TW); Kai-Cheng Chuang, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 189 days.

(21) Appl. No.: 13/616,880

(22) Filed: Sep. 14, 2012

(65) Prior Publication Data

US 2014/0042922 A1 Feb. 13, 2014

(30) Foreign Application Priority Data

Aug. 10, 2012 (TW) ..... 101128936

(51) Int. Cl.
*H05B 37/00* (2006.01)

(52) U.S. Cl.
USPC ..... 315/201; 315/291; 315/224

(58) Field of Classification Search
USPC ..... 315/201, 291, 224, 312, 308, 307, 315/209 R, 226
See application file for complete search history.

(56) References Cited

U.S. PATENT DOCUMENTS 8,076,920 B1 * 12/2011 Melanson ..... 323/299
8,427,070 B2 * 4/2013 Matsuda ..... 315/291

* cited by examiner

*Primary Examiner* — Daniel D Chang
(74) *Attorney, Agent, or Firm* — Rosenberg, Klein & Lee

(57) ABSTRACT

A LED driving device comprises a rectification circuit, a holding current circuit and a driving circuit to drive and linearly regulates an illumination brightness of at least one LED by utilizing level variation of current magnitude. The rectification circuit rectifies and outputs a rectified voltage to the holding current circuit and the driving circuit by filtering impulses via a filter after receiving an alternating current voltage. The driving circuit outputs a driving current filtered by a filter capacitor to the LED, and the driving current is sensed by a sensing resistor to allow the holding current circuit outputting a holding current to the rectification circuit such that the whole circuit power can be improved to reduce problems of noise interference and twinkling.

8 Claims, 4 Drawing Sheets

LIGHT EMITTING DIODE DRIVING DEVICE

CROSS-REFERENCE TO RELATED APPLICATIONS

This non-provisional application claims priority under 35 U.S.C. §19(a) on Patent Application No(s). 101128936 filed in Taiwan, R.O.C. on Aug. 10, 2012, the entire contents of which are hereby incorporated by reference.

BACKGROUND OF THE INVENTION

1. Field of the Invention

The invention relates to a technique field of an electric light source circuit device, and more particularly to a constant current type light emitting diode (LED) driving device. Therefore, when the brightness of the LED is linearly regulated by a tri-electrode AC switch (TRIAC) at the same time, impulses and noise generated during the conversion of the voltage source are reduced such that the LED may not generate twinkling, and the efficacy of the whole circuit device can be improved.

2. Description of the Related Art

After light emitting diodes (LED) leads the illumination markets due to its features of low power consumption and high efficacy, controlling the illumination brightness, working efficiency or service life of LED lamps become a goal studied by each company. Currently, the driving device of the LED lamp usually adopts a circuit design architecture having constant current to allow LEDs cascading a transistor and a sensing resistor such that before a TRIAC switches the conduction angle of an input voltage to regulate its brightness, the sensing resistor examines the driving current of the LED to form a voltage drop, and the voltage drop is compared with the input voltage through a comparator to output high level voltage or low level voltage to the transistor such that the transistor is properly conducted or discontinued to regulate the duty cycle of a pulse width modulation (PWM) signal, to control driving voltage magnitude, thereby influencing driving current magnitude and the illumination brightness of LEDs.

However, according to current/voltage (I/V) character curve, the LED is not a linear component. In another word, ratio value of voltages to current is not direct proportion. Therefore, the foregoing dimming method may cause incorrect dimming effect due to inconsistent change between the driving voltage and the driving current. Further, the illumination brightness of the LED controlled by utilizing the duty cycle of the PWM signal may have problem of electromagnetic interference (EMI) while switching frequencies. Consequently, to meet the safety requirement, related lamps must add safety components to decrease the practicability.

SUMMARY OF THE INVENTION

In view of the shortcomings of the prior art, the inventor(s) of the present invention based on years of experience in the related industry to conduct extensive researches and experiments, and finally developed an LED driving device having high power factors as a principle objective such that LEDs can be driven by circuit architectures having constant current and linear dimming to avoid problems of generating twinkling or noise interferences due to extremely high or low dimming frequency.

To achieve the foregoing objective, the LED driving device is installed on a LED lamp board to drive and linearly regulate an illumination brightness of at least one LED and comprises a rectification circuit, a holding current circuit and a driving circuit. The rectification circuit is electrically connected to an alternating current power and the holding current circuit. The driving circuit is coupled to the holding current circuit and the LED. The rectification circuit is disposed with a filter and a rectifier. The filter filters impulses after receiving an alternating current voltage, a rectified voltage capable of being converted into variable constant current is rectified and outputted by the rectifier. The holding current circuit is disposed with a current switch, and a holding current is outputted to the rectification circuit when the current switch is conducted. The driving circuit is disposed with a filter capacitor and a sensing resistor. The rectified voltage is received and filtered by the filter capacitor to form a driving current, and the driving current is outputted to the LED. The driving current is sensed by the sensing resistor to form a control signal to conduct or discontinue the current switch.

To implement the linear dimming, the rectification, circuit is further disposed with a bidirectional triode thyristor coupled between the AC power and the filter to receive the voltages of the AC power and form the AC voltage after regulating a phase conduction angle.

The rectifier is a full-wave bridge rectifier. The current switch is an N-type metal-oxide-semiconductor field effect transistor (MOSFET), and its gate is coupled to the driving circuit. When the bidirectional triode thyristor performs dimming to change driving current magnitude, the driving circuit outputs the control signal having low voltage level to conduct the current switch. The holding current circuit is disposed with a bleeder resistor. When the current switch is conducted, the bleeder resistor receives the rectified voltage to form the holding current such that additional power can be consumed by the bleeder resistor to retain a certain current to allow the bidirectional triode thyristor to normally work.

The filter capacitor is connected to the LED in parallel to enhance power to retain power factors (PF) that is greater than 0.9. The LED is coupled to the sensing resistor after cascading a transistor. The transistor is an N-type MOSFET, and its gate is coupled to the driving circuit. The transistor is placed on a surface of the LED lamp board to speed up heat dissipation, thereby effectively improving working qualify and service life.

In summary, the invention utilizes the filter to filter current impulses prior to rectification such that the TRIAC can stably work and have efficacy, and the working current of the TRIAC can be retained by the bleeder resistor to improve the working quality and steady. After rectifying via the bridge rectifier, the circuit power can be greatly improved since the rectified voltage, which is directly charged and discharged by the filter capacitor, is supplied to the LED, and twinkling phenomenon can be prevented. At the same time, the LED driving device does not use a transformer or an inductor to perform PWM switching. Therefore, there is no EMI interference to reduce related EMI safety components. Its structure is simple and needs fewer parts to reduce costs.

DETAILED DESCRIPTION OF THE PREFERRED EMBODIMENTS

The technical content of the present invention will become apparent by the detailed description of the following embodiments and the illustration of related drawings as follows.

Figure 1:
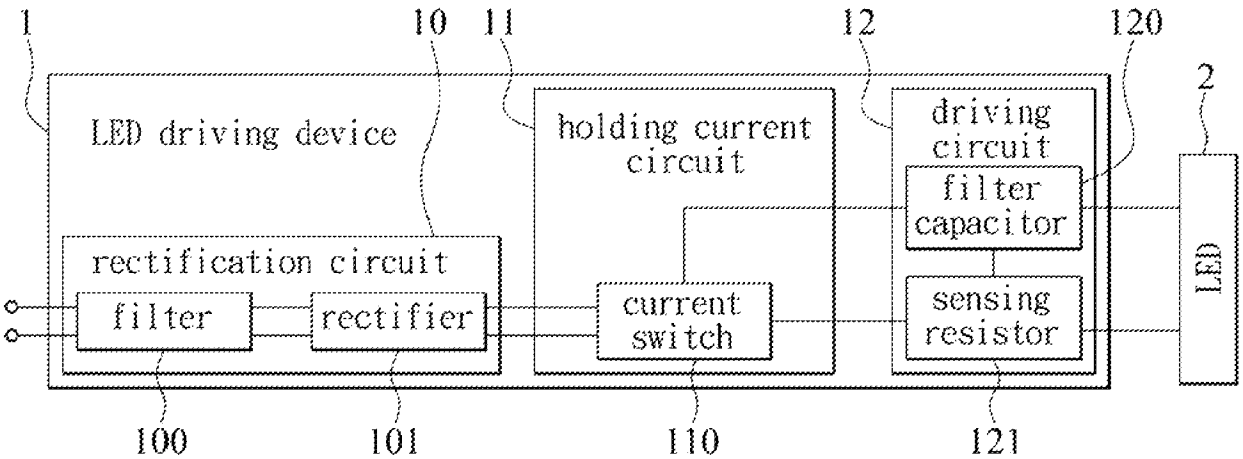
FIG. 1 is a block diagram of an example according to a preferred embodiment of the invention.

With reference to FIG. 1 for a block diagram of a state according to a preferred embodiment of the invention is depicted. As shown in the figure, a LED driving device 1 is suitable for illumination equipments of indoor and outdoor spaces, such as stages, movie theaters, stadiums or meeting rooms, thereby driving and linearly regulating the illumination brightness of at least one LED 2. The LED driving device 1 is installed on a LED lamp board (not shown in the figure) and comprises a rectification circuit 10, a holding current circuit 11 and a driving circuit 12. The rectification circuit 10 is disposed with a filter 100 and a rectifier 101. The holding current circuit 11 is disposed with a current switch 110. The driving circuit 12 is disposed with a filter capacitor 120 and a sensing resistor 121. The rectification circuit 10 is coupled to an alternating current (AC) power through the filter 100, and the rectification circuit 10 is also coupled to the holding current circuit 11 an the driving circuit 12 through the rectifier 101. The current switch 110 is coupled to the driving circuit 12. The driving circuit 12 is coupled to the LED 2 through the filter capacitor 120 and the sensing resistor 121.

After the filter 100 filters impulses by receiving an alternating current voltage of the AC power, a rectified voltage capable of being converted into variable constant current is rectified and outputted by the rectifier 101 to the holding current circuit 11 and the driving circuit 12 such that the filler capacitor 120 receives and filters the rectified voltage to form a driving current $I_{LED}$, and the driving current $I_{LED}$ is outputted to the LED 2. The driving current $I_{LED}$ is sensed by the sensing resistor 121 to form a control signal to conduct or discontinue the current switch 110. When the current switch 110 is conducted, a holding current is outputted by the holding current circuit 11 to the rectification circuit 10 to ensure its normal operation.

Figure 2:
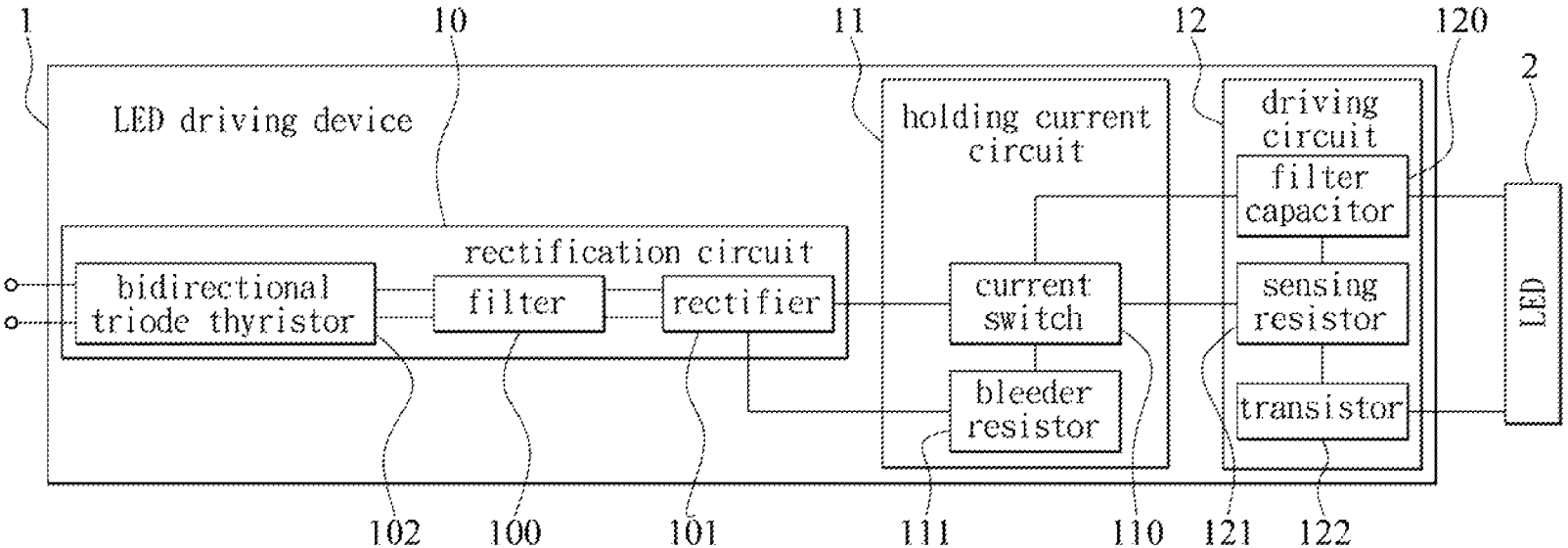
FIG. 2 is a block diagram of another example according to a preferred embodiment of the invention.
Figure 3:
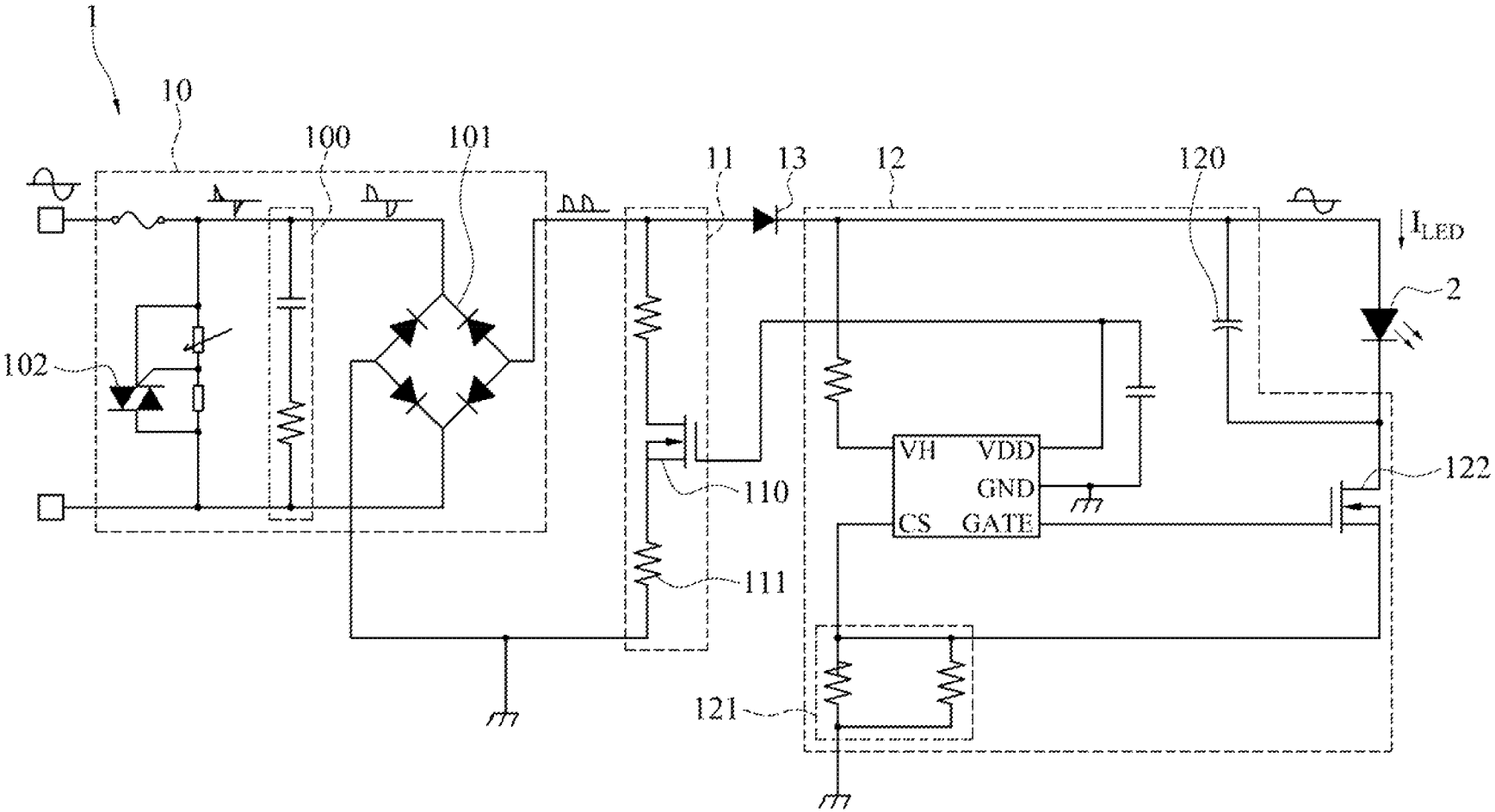
FIG. 3 is a circuit diagram of another example according to a preferred embodiment of the invention.

With reference to FIG. 2 and FIG. 3 for a block diagram and a circuit diagram of another example according to a preferable embodiment of the invention are respectively depicted. As shown in the figures, a bidirectional triode thyristor 102 is disposed between the AC power and the filter 100 to form a TRIAC dimmer. The filter 100 can be composed of a capacitor cascaded with a resistor. The rectifier 103 is a full-wave bridge rectifier. After the bidirectional triode thyristor 102 receives the AC voltage, its phase conduction angle is regulated, and the filter 100 filters current impulses by charging and discharging the capacitor and consuming the energy of the resistor, thereby forming the AC voltage through the rectification of the full-wave bridge rectifier.

Figure 4:
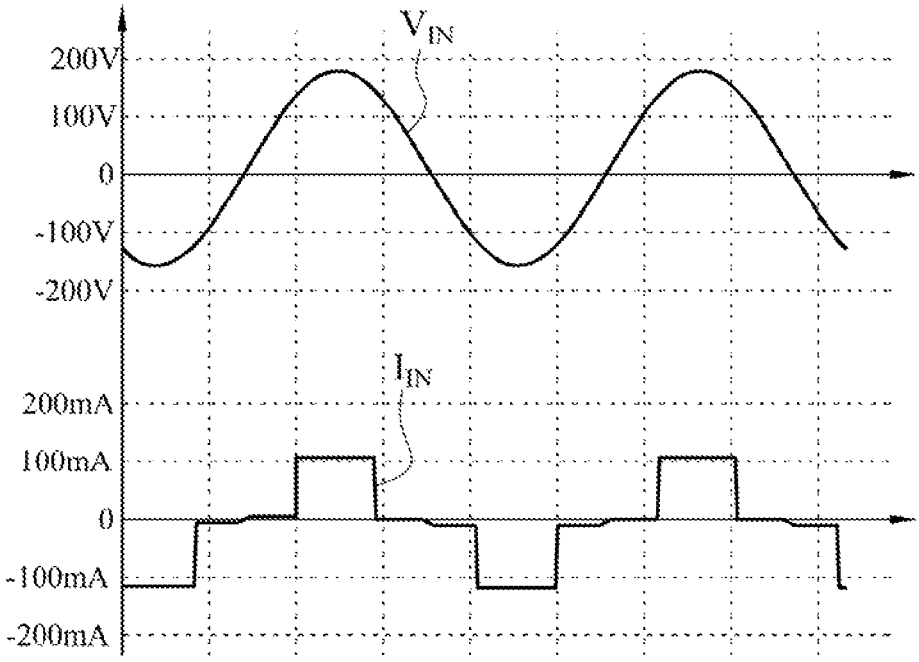
FIG. 4 is a waveform diagram of inputted voltage and current of another example according to a preferred embodiment of the invention.
Figure 5:
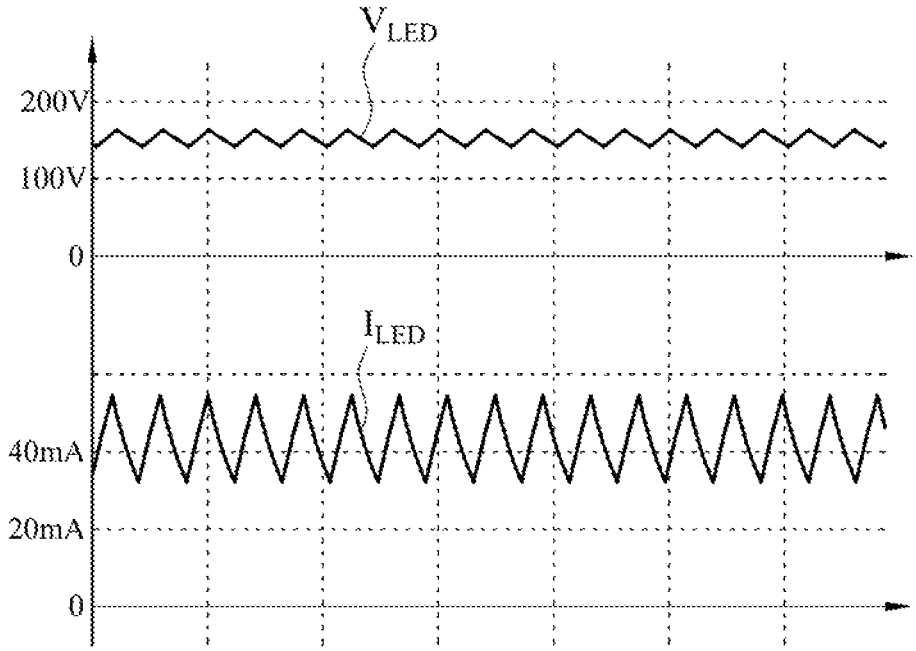
FIG. 5 is a waveform diagram of outputted voltage and current of another example according to a preferred embodiment of the invention.

The driving circuit 12 takes a control chip as a main component and is disposed with the filter capacitor 120, the sensing resistor 121 and a transistor 122. The LED 2 is coupled to the control chip after connecting the filter capacitor 120 in parallel and is coupled to the holding current circuit 11 and the rectification circuit 10 through a diode 13. The LED 2 is cascaded to a drain of the transistor 122 and coupled to an input pin of the control chip after cascading the sensing resistor 121 through a source of the transistor 122 so that the voltage drop generated by the driving current $I_{LED}$, which is sensed by the sensing resistor 121, is inputted. The transistor 122 is an N-type MOSFET (metal-oxide-semiconductor field-effect transistor), wherein its gate is coupled to an output pin of the control chip. The voltage drop detected by the control chip is lower than a standard level, a low voltage level is outputted to conduct the transistor 122 to properly regulate the driving current $I_{LED}$, thereby retaining a constant state. Accordingly, the AC inputted and outputted voltages and currents of the LED driving device 1 accurately measured by an oscilloscope are shown in FIG. 4 and an attachment 1, FIG. 5 and an attachment 2 for waveform diagrams and measure figures of inputted voltages and currents of another example according to a preferred embodiment of the invention. If the AC power inputs AC 120V ($V_{IN}$), two ends of the filter capacitor 120 can output voltage 124 ($V_{LED}$) to achieve the effect of PF that is greater than 0.9, and the driving current $I_{LED}$ slightly shows a sinusoid state to improve the working quality of the LED 2.

The holding current circuit 11 is disposed with a bleeder resistor 111, and the current switch 110 is an N-type MOSFET, wherein its gate is coupled to an output pin of the control chip, and its source is coupled to an output end of the full-wave bridge rectifier through the bleeder resistor 111. The drain of the current switch 110 is coupled to another output end of the full-wave bridge rectifier after cascading a resistor, thereby speeding up the consumption of additional electric energy and steadying current. When the bidirectional triode thyristor 102 performs dimming to change the magnitude of the driving current $I_{LED}$, the control chip outputs the control signal having low voltage level to conduct the current switch 110 such that rectified voltage is received by the bleeder resistor 111 to form the holding current to retain dimming and prevent the LED from twinkling. It should be noted that the transistor 122 can be placed on a surface of the LED lamp hoard to speed up the heat dissipation, thereby effectively improving the working quality and the service life.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A LED driving device disposed to a LED lamp board to drive and linearly regulate an illumination brightness of at least one LED, the LED driving device comprising:

a rectification circuit electrically connected to an alternating current power and disposed with a filter and a rectifier, a rectified voltage capable of being converted into variable constant current being outputted by the rectifier after the filter filtering impulses by receiving an alternating current voltage;

a holding current circuit coupled to the rectification circuit and disposed with a current switch, the holding current circuit receiving the rectified voltage to output a holding current to the rectification circuit while conducting the current switch; and a driving circuit coupled to the holding current circuit and the LED, the driving circuit disposed with a filter capacitor, a transistor, a control chip, and a sensing resistor, the filter capacitor receiving and filtering the rectified voltage to form a driving current, the driving current outputted to the LED, the sensing resistor sensing the driving current to form a control signal to conduct or discontinue the current switch, wherein, an end of the LED is directly cascaded to a drain of the transistor, and then coupled to an input pin of the control chip after cascading the sensing resistor through a source of the transistor.

2. The LED driving device of claim 1, wherein the rectification circuit is further disposed with a bidirectional triode thyristor coupled between the alternating current power and the filter to receive a voltage of the alternating current power and form an alternating current voltage after regulating a phase conduction angle.

3. The LED driving device of claim 2, wherein the rectifier is a full-wave bridge rectifier.

4. The LED driving device of claim 3, wherein the current switch is an N-type metal-oxide-semiconductor field-effect transistor (MOSFET), and a gate of the current switch is coupled to the driving circuit, and when the bidirectional triode thyristor performs dimming to change a magnitude of the driving current, the driving circuit outputs the control signal having low voltage level to conduct the current switch.

5. The LED driving device of claim 4, wherein the holding current circuit is disposed with a bleeder resistor, and when the current switch is conducted, the bleeder resistor receives the rectified voltage to form the holding current.

6. The LED driving device of claim 5, wherein the filter capacitor is connected to the LED in parallel to enhance power so as to retain a power factor that is greater than 0.9.

7. The LED driving device of claim 6, wherein the LED is coupled to the sensing resistor after cascading a transistor, and the transistor is an N-type metal-oxide-semiconductor field-effect transistor (MOSFET), and a gate of the transistor is coupled to the driving circuit.

8. The LED driving device of claim 7, wherein the transistor is placed on a surface of the LED lamp board to speed up heat dissipation.

* * * * *